US005154228A

United States Patent [19]

Gambertoglio et al.

[11] Patent Number: 5,154,228

[45] Date of Patent: Oct. 13, 1992

[54] VALVING SYSTEM FOR HURRICANE PLUGS

[76] Inventors: Louis M. Gambertoglio, 195 S. Deerfoot, The Woodlands, Tex. 77380; Michael J. Loughlin, 2523 Droxford, Houston, Tex. 77008; Louis E. West, Jr., 14810 Tilley St., Houston, Tex. 77084

[21] Appl. No.: 526,978

[22] Filed: May 22, 1990

[51] Int. Cl.[5] ..... E21B 33/12; E21B 24/14

[52] U.S. Cl. ..... 166/124; 166/133; 166/135; 166/188; 166/192; 166/332; 166/386

[58] Field of Search ..... 166/381, 382, 386, 387, 166/124, 133, 135, 188, 192, 332, 316

[56] References Cited

U.S. PATENT DOCUMENTS

| | | | |
|---|---|---|---|
| 2,507,262 | 5/1950 | McGivern | 166/124 |
| 2,928,469 | 3/1960 | Crowe | 166/135 |
| 3,002,563 | 10/1961 | Crowe | 166/135 |
| 3,054,453 | 9/1962 | Bonner | 166/135 |
| 3,493,052 | 2/1970 | Evans et al. | 166/332 |
| 4,440,233 | 4/1984 | Baugh et al. | 166/124 |
| 4,598,774 | 7/1986 | Nevels et al. | 166/124 |

*Primary Examiner*—Bruce M. Kisliuk

[57] ABSTRACT

A tubular body containing a sleeve actuated safety valve is attachable to the top end of a hurricane plug. A running tool has a floating nut connection with the tubular body and a tubular extension on the running tool effects the opening of the safety valve while connected to the tubular body. After setting the hurricane plug, the running tool is disconnected from the tubular body by setdown weight, followed by rotation. A retrieving tool has an external threaded section which is threaded through an internal threaded section in the tubular body to engage the actuating sleeve for the safety valve, and effect the opening of the safety valve. Further rotation of the running tool engages the retrieving tool with the tubular body to effect the unsetting of the hurricane plug and permit the removal of the tubular body, hurricane plug and depending tool string from the well by the retrieving tool.

22 Claims, 6 Drawing Sheets

VALVING SYSTEM FOR HURRICANE PLUGS

BACKGROUND OF THE INVENTION

1. Field of the Invention

The invention relates to a valving system for a hurricane plug, including a tubular body mounting a safety valve, a running tool and a retrieving tool.

2. Summary of the Prior Art

Hurricane plugs have long been known in the well drilling industry. When drilling a subsea well from a drilling vessel or barge, an impending storm necessitates that the vessel or barge be disconnected from the well and the well sealed shut until the storm has passed. Many times there is not sufficient advance warning of a storm to permit the drilling tool string to be removed from the well. In such cases, a hurricane plug, which is the equivalent of a packer, is secured to the top end of the drilling string and lowered into the well by a running tool. A valving system must be concurrently inserted in the well to prevent fluid flow upwardly out of the well when the running tool is disconnected from the hurricane plug after the setting of the hurricane plug is accomplished.

It is very important that the running tool not be withdrawn from the hurricane plug until the hurricane plug is set because the entire drilling string could be blown out of the well by pressurized well fluids existing below the hurricane plug.

It is equally important in the retrieval of the hurricane plug that the safety valve be opened as part of the retrieval operation so as to equalize pressures above and below the safety valve.

For this reason, a valving system, including a safety valve, special running tool and a special retrieval tool capable of performing all of the aforementioned operations in a thoroughly reliable manner, is a highly desired improvement in the well drilling art.

SUMMARY OF THE INVENTION

While not limited thereto, this invention may be used with a hurricane plug of the type currently sold by BAKER SERVICE TOOLS DIVISION of BAKER HUGHES CORPORATION as BAKER MODEL "B" RETRIEVAMATIC/HURRICANE PLUG, Product #407-09. This hurricane plug, which is threadably attachable to the top end of the drilling string, in effect constitutes a packer which can be set rotation to the right, followed by the setdown of weight. Unsetting of the packer is accomplished by further rotation to the right.

A valving system embodying this invention comprises a tubular body element within which is mounted a conventional safety valve which may be either of the ball or flapper type but is herein illustrated as being of the flapper type. An actuating sleeve for the flapper is conventionally mounted above the position of the flapper. The tubular body incorporates in its bore a set of threads which effect the securement of the tubular body to a running tool. The lower end of the tubular body is threadably secured to the top end of the hurricane plug. The running tool is a substantial duplicate of the running tool shown and described in U.S. Pat. No. 4,598,774. Such running tool incorporates a floating nut which cooperates with the threaded internal bore portion of the tubular body element.

In the run-in position, the tubular body element is axially and co-rotatably secured to the running tool so that when the hurricane plug reaches the desired depth in the well, the hurricane plug may be set by rotation to the right of the tubular string supporting the running tool. The rotation to the right is followed by the application of setdown weight to complete the setting of the hurricane plug.

The running tool also includes a depending tubular element threadably secured to its lower end which is engagable with the actuating sleeve for the safety valve and effects the opening of the safety valve by the initial assemblage of the running tool to the internal threaded portion of the tubular body element. Thus, the safety valve is in an open position during run-in which is a very desirable condition when time is of the essence for completing the insertion and setting of the hurricane plug.

After setting of the hurricane plug, the application of a further setdown weight to the running tool will effect the shearing of a shear pin and release a mandrel for a downward movement by setdown weight which results in the removal of an axial restraining key from operative engagement with the floating nut. Thus, subsequent rotation of the running tool to the right will effect an axial displacement of the floating nut to release from the threaded bore portion of the tubular body element, thus permitting the running tool to be removed from the well. The removal of the running tool automatically permits the safety valve to close under the bias of springs conventionally provided on both the actuating sleeve and the flapper element of such valve.

Thus, the hurricane plug may be expeditiously set within the well to support the drilling string in depending relationship thereto and the bore through the drilling string will be closed by the safety valve. The well is thus secured against any inadvertent blowout produced by fluid pressures below the closed safety valve.

After a threatened storm has passed, a retrieving tool embodying this invention is run into the well. Such retrieving tool has a depending sleeve which is engagable with the top end of the safety valve actuating sleeve during the insertion operation to produce a downward displacement of the safety valve actuating sleeve to open the safety valve and effect the necessary pressure balancing. The running tool is secured to the tubular body element by external threads which cooperate with a second internally threaded section provided in the bore of the tubular body. A guide sleeve is secured to the running tool in radially spaced, surrounding relationship to the threaded portion. Thus, the retrieving tool may be conveniently guided into concentric relationship with the upstanding end portion of the tubular body element and the threads on the retrieving tool conveniently engaged with the internally threaded bore portion of the tubular body element. Such threaded engagement results in the downward displacement of the retrieving tool, thus moving the depending sleeve into operative engagement with the safety valve actuating sleeve to effect the opening of the safety valve.

A stop shoulder is provided on the retrieving tool which is engagable with an internal upwardly facing shoulder provided in the bore of the tubular body element. These shoulders do not engage until the retrieving tool has been advanced downwardly a sufficient distance to insure that the safety valve is open. Further rotation of the retrieving tool will rotate the tubular body and unset the hurricane plug.

The retrieving tool may then be removed from the well and will carry with it the tubular body element, with the opened safety valve, the hurricane plug and the depending drilling string.

Those skilled in the art will appreciate that the aforedescribed construction provides the utmost safety in operation. The running tool cannot be detached from the tubular body element until the hurricane plug is set. In the retrieving operation, the safety valve is opened by the downwardly advancing movement of the retrieving tool, equalizing pressures above and below the safety valve, thus permitting the unsetting of the hurricane plug without any fluid pressures being exerted on the safety valve.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
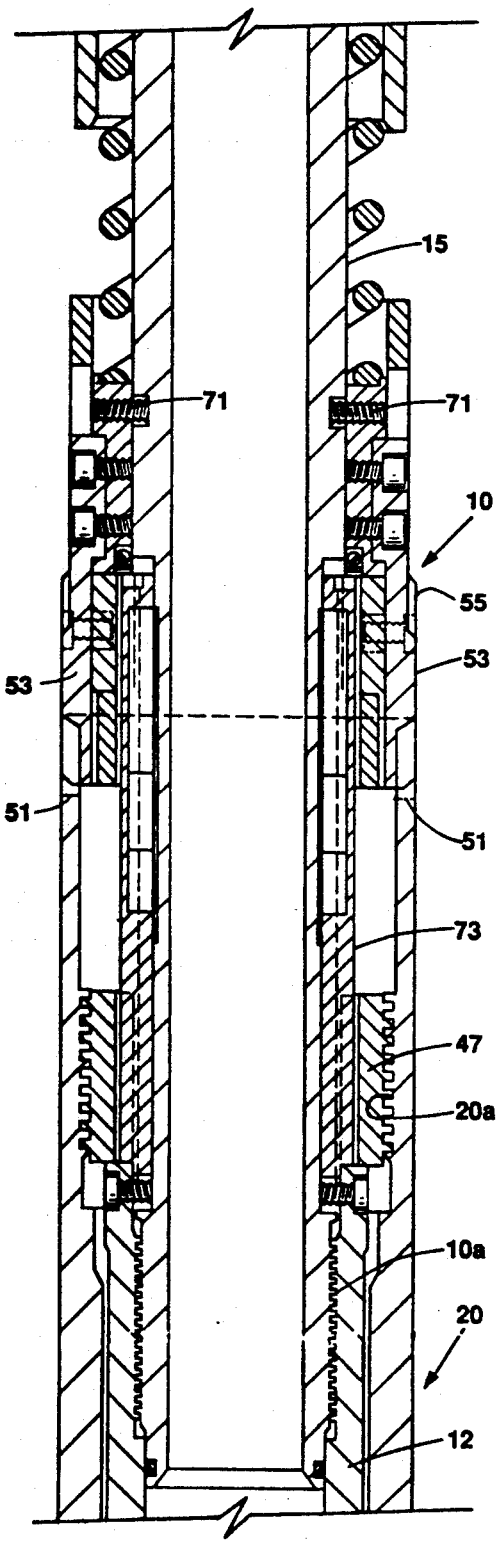
FIGS. 1A, 1B and 1C vertical, sectional views of a valving system embodying this invention with the tubular body element which internally mounts a safety valve are shown in secured relationship to a running tool, with the safety valve being shown in its opened position.
Figure 2A:
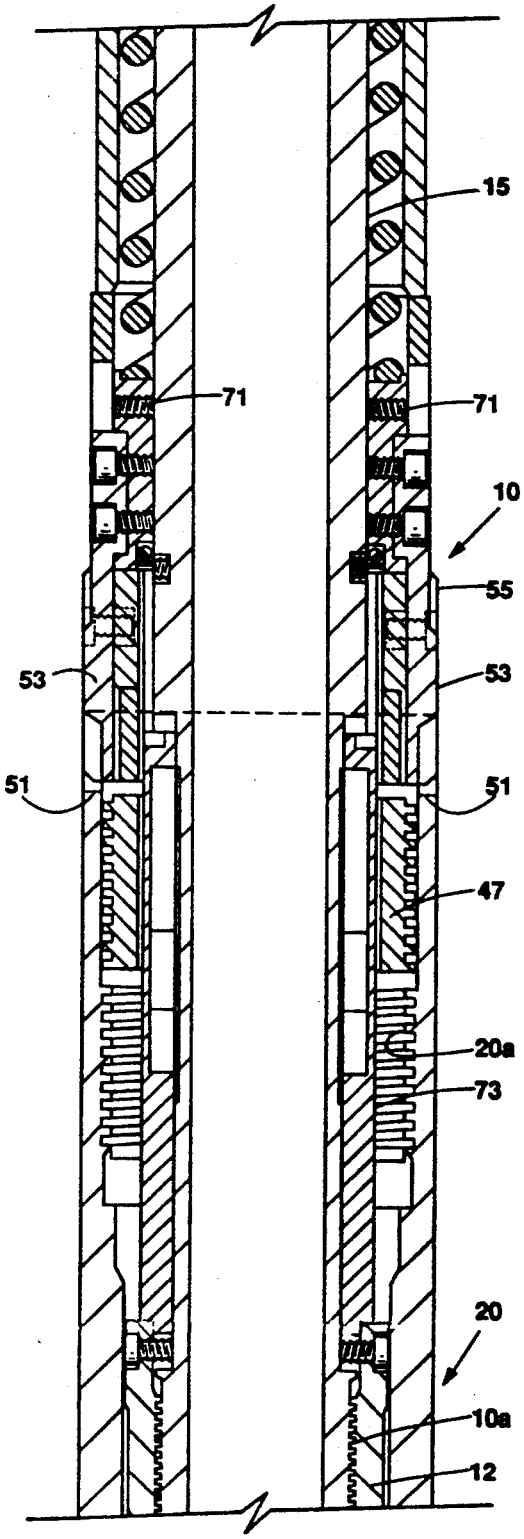
FIG. 2A is a view similar to FIG. 1A but showing the upward shifting of the floating nut to effect the detachment of the running tool from the tubular body element by rotation after the setting of the hurricane plug.
Figure 1B:
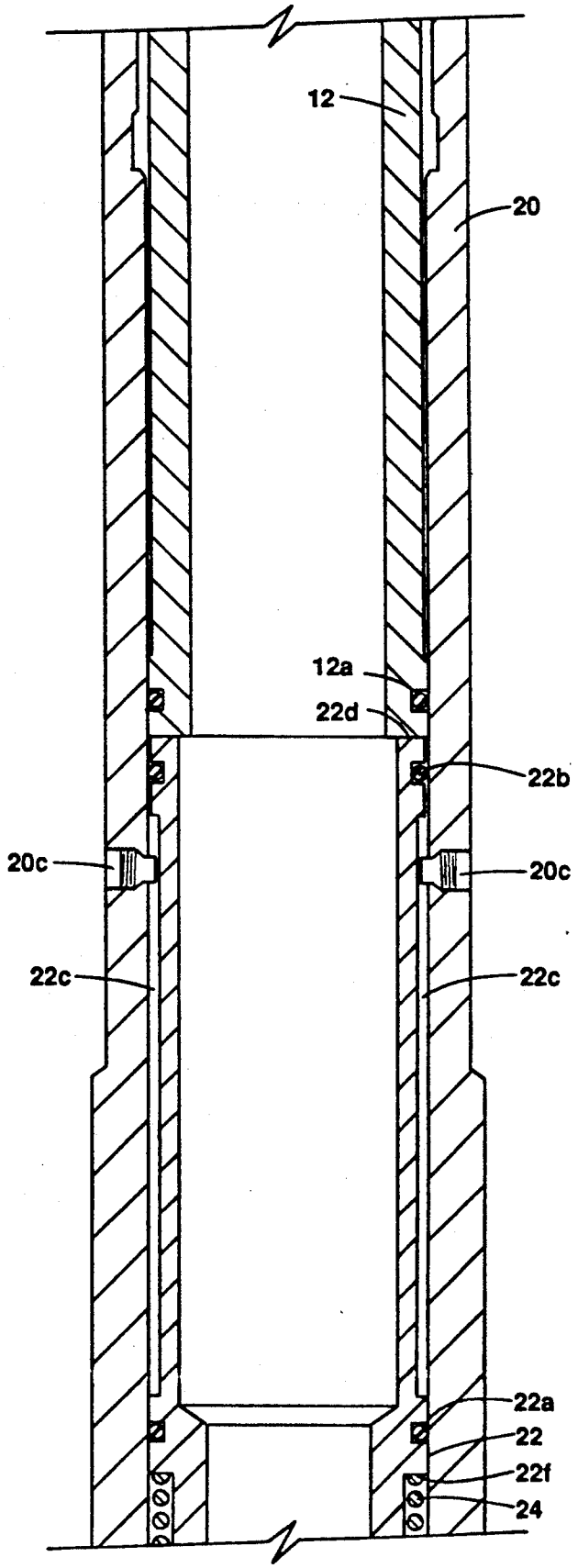
Figure 1C:
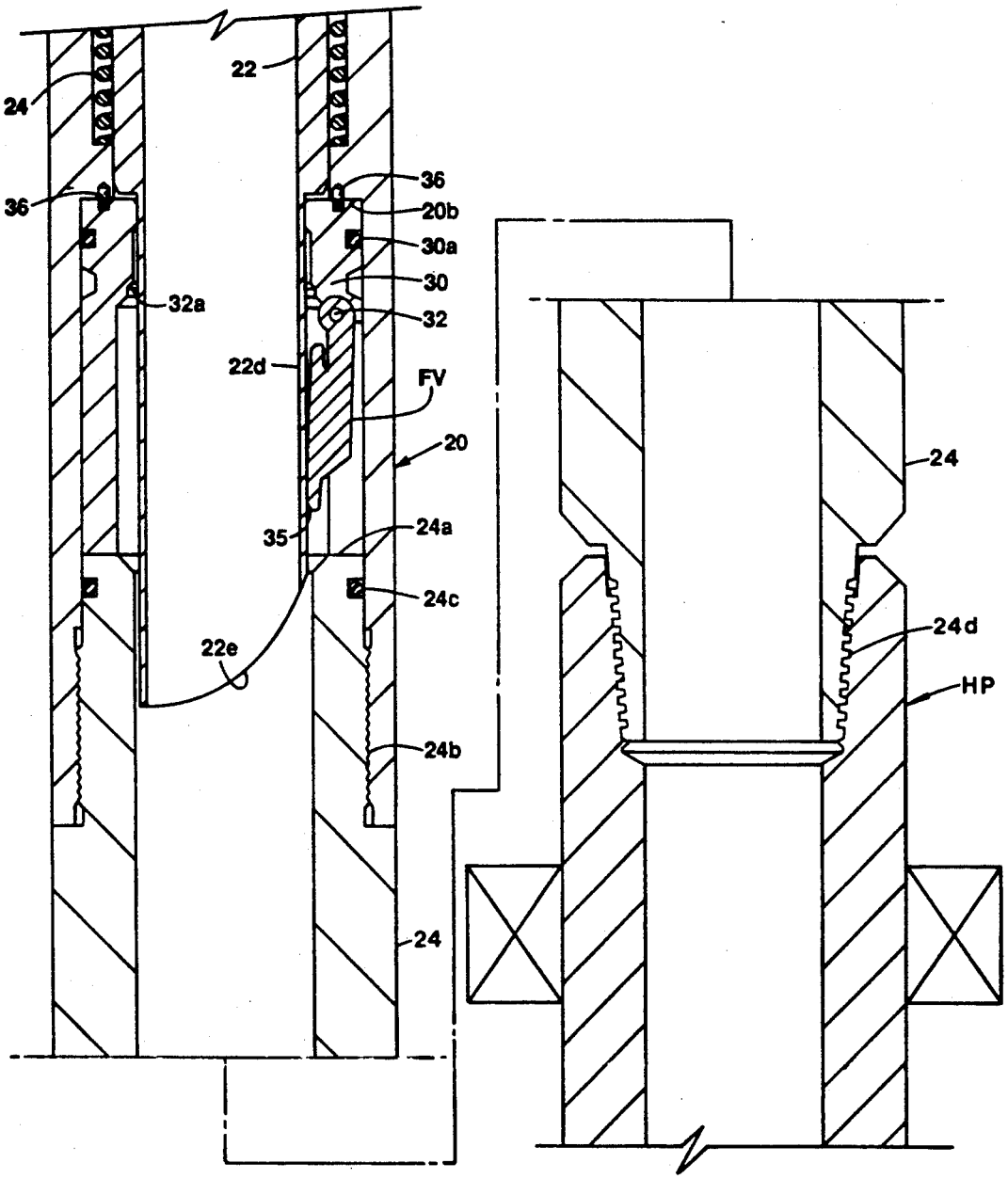

Referring to FIGS. 1A, 1B and 1C, there is shown in assembled relationship, a running tool 10 which is operatively secured to a tubular body element 20 which incorporates a sleeve actuated safety valve represented by the flapper valve FV. The running tool 10 is substantially identical to that shown in U.S. Pat. No. 4,598,774. Thus the running tool incorporates an externally left hand threaded floating nut 47, a key structure 73, a mandrel 15 carrying the key structure 73 and shear pins 71 securing the mandrel 15 to torque collar 55 to prevent downward movement of mandrel 15 relative to the setting sleeve 13 of the running tool, and torque fingers 53. All of these numerals appear on the drawings of the aforementioned U.S. Pat. No. 4,598,774, hence further description of the running tool is deemed unnecessary.

Tubular body element 20 takes the place of setting sleeve 13 of the aforementioned Patent, and is provided on its upper end with notches 51 to receive torque fingers 53, and in its bore with internal, left hand threads **20*a* for cooperative engagement with the externally threaded floating nut 47 of the running tool 10**.

A safety valve assemblage comprises an annular structure 30 which is insertable in the bore of the tubular element 20 immediately below an inwardly projecting shoulder **20*b*. Such annular structure is axially slotted to permit the pivotal mounting of flapper valve FV (FIG. 1C) on a pin 32 traversing the side wall of the assemblage 30. Assemblage 30 also defines an annular valve seat 32*a* which cooperates with the upwardly facing peripheral edge 35 of the flapper valve FV. The annular structure 30 is further provided with an O-ring seal 30*a* which cooperates with the internal bore of the tubular body element 20**.

The safety valve assemblage 30 is held in position by the upwardly facing end **24*a* of a connection sub 24. Connection 24 is secured to the bottom end of the tubular body element 20 by threads 24*b* and such threads are sealed by an O-ring 24*c*. The lower end of connection sub 24 is provided with reduced diameter external threads 24*d*** which are engagable with the top end of any conventional hurricane plug (HP) which can be set by rotation in a selected direction, generally rotation to the right, followed by the application of a setdown weight. Since such hurricane plugs are well known in the art, further description of the plug is deemed unnecessary.

An actuating sleeve 22 for the flapper valve FV is mounted for slidable movements within the bore of the tubular body element 20 and is biased upwardly by a compression spring 50, which engages a downwardly facing shoulder **22*f*. A seal 22*a* is provided in a medial portion of the actuating sleeve 22 and a second O-ring seal 22*b* is provided at the upper end of the actuating sleeve 22. Actuating sleeve 22 is restrained against angular movements relative to the tubular body element, hence relative to the flapper valve FV by a pair of elongated slots 22*c* formed intermediate the location of the O-ring seals 22*a* and 22*b*. The slots 22*c* respectively cooperate with guide pins 20*c* threaded into the wall of the tubular body element 20**.

The extreme lower end of the actuating sleeve 22 is of reduced diameter and thickness as indicated at **22*d* and the bottom surface of this reduced diameter portion is arcuately contoured as indicated at 22*e* so as to provide an engagement with the top face of the flapper FV which progresses from a point on the flapper most remote from the pivot pin 32 to a point moving closer to the pivot pin 32** as the flapper valve FV is pivoted downwardly. This configuration for the bottom of an actuating sleeve is well known in the prior art.

From the foregoing description, it will be apparent that the flapper valve FV is normally disposed in its closed position, being biased there by a torsion spring (not shown) and being not engaged by the bottom end **22*e* of the actuating sleeve 22 which is held in its uppermost position by the compression spring 50. It should be further noted that the annular structure 30 is secured in a fixed angular position relative to the tubular body element 20 by one or more axially disposed locating pins 36 which are mounted between the bottom surface of the shoulder 20*b* and the top surface of the annular structure 30. Vertical pins 36 thus secure flapper valve 30, in fixed angular relationship with actuating sleeve 22**.

In accordance with this invention, a tubular force transmitting element 12 is attached to threads **10*a* conventionally provided on the bottom end of the running tool 10. A seal 12*a* cooperates with the bore of tubular body element 20. The tubular element 12 engages the top end of the actuating sleeve 22 for the flapper valve FV and, when the threads 20*a* of tubular body element 20** are fully engaged with the threads of the floatable nut 47 of running tool 10, the tubular force transmitting element 12 will have forced the actuating sleeve 22 downwardly sufficient to open the flapper valve FV to the position shown in FIG. 1C. This insures that the bore through the hurricane plug and the running tool will be open when the hurricane plug, with the depending drill string, is being inserted in the well, thus expediting the passage of the tool downwardly through whatever fluids exist in the well at the time of such insertion.

The hurricane plug is normally attached to the top of a drill string, because the sole purpose of installing the hurricane plug is to eliminate the necessity of removing the drill string because of a threatening storm. When the hurricane plug has been lowered to a desired location in the well, it can be set by right hand rotation of the tubular string (not shown) on which the running tool 10 is suspended. As is fully described in the aforementioned U.S. Pat. No. 4,598,774, rotation of the running tool 10 does not effect any change of position of the floating nut 47 since it is secured for co-rotation with tubular body element 20 and the torque collar 55 by the key element 73. Hence, such rotational movement is imparted to the hurricane plug through tubular body element 20 and initiates the setting operation which is completed by setting down weight through the running tool 10 and the tubular body element 20 onto the hurricane plug.

Once the plug is set, the addition of setdown weight to the running tool 10 effects the shearing of pins 71, thus freeing the mandrel 15 for downward movement. Such downward movement removes the top end of the key 73 from a position of engagement with the surrounding torque collar 55 to a position permitting right hand rotational movement of the splines 73 relative to tubular body 20, hence imparting a rotational movement to the floating nut 47, causing such nut to threadably rise out of the internal left hand threads 20*a* provided on the tubular body element 20, thereby disengaging the running tool 10 from the tubular body element 20. Running tool 10 can then be removed from the well and the well is protected from any adverse effects of the threatened storm by virtue of the fact that the hurricane plug is in a set, sealed engagement with the bore of the well casing and the safety valve, in this instance the flapper valve FV, is in its closed position which it assumes as the tubular force transmitting element 12 attached to the running tool 10 is moved upwardly by the retrieval of the running tool 10.

It will be readily apparent to those skilled in the art that the installation of the hurricane plug can not only be expeditiously accomplished, but accomplished with the assurance that the hurricane plug is firmly set in the well prior to disengagement of the running tool 10 from the tubular body element 20. This assurance is provided by the fact that the floating nut 47 cannot be disengaged from the running tool 10 until setting of the hurricane plug has occurred sufficient to withstand the setdown forces imparted to the mandrel 15 of the running tool 10 to effect the shearing of shear pins 71.

Figure 3A:
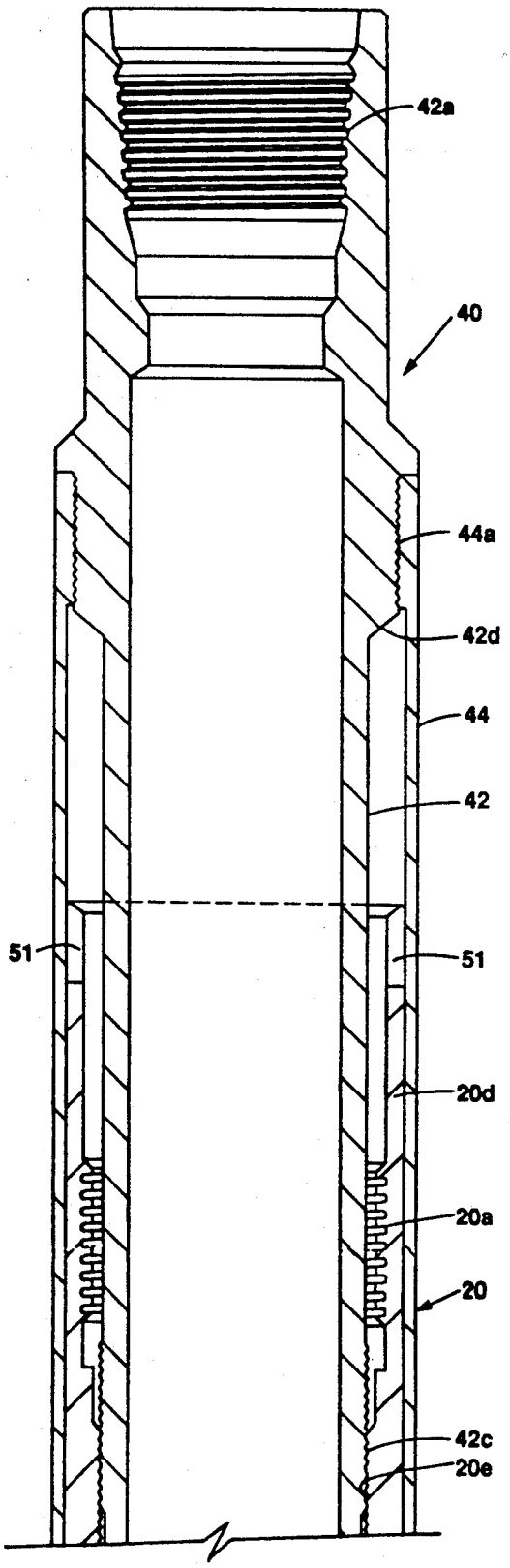
FIGS. 3A, 3B and 3C constitute a vertical, sectional view of the tubular body element with the retrieving tool shown in an initial position relative to the tubular body element.
Figure 4A:
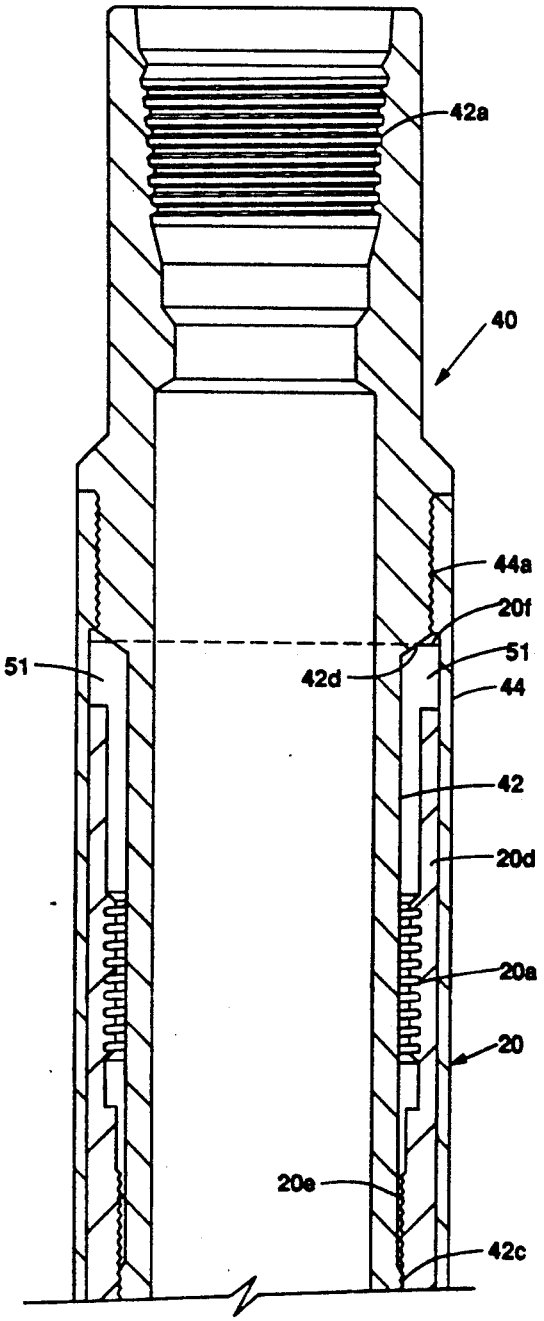
FIGS. 4A, 4B and 4C views respectively similar to FIGS. 3A, 3B and 3C but showing the retrieving tool in its final position relative to the tubular body element wherein the safety valve is in its full open position, wherein it is nonrotatably secured to the tubular body element to effect the unsetting of the hurricane plug by rotation to the right.
Figure 3B:
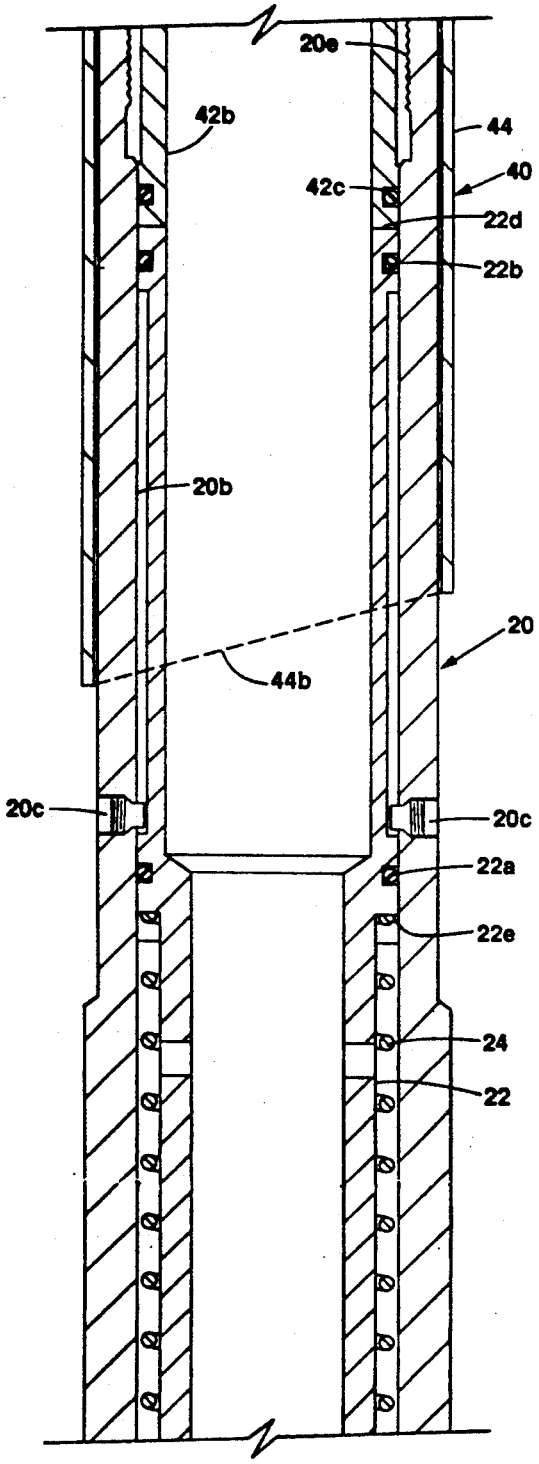
Figure 4B:
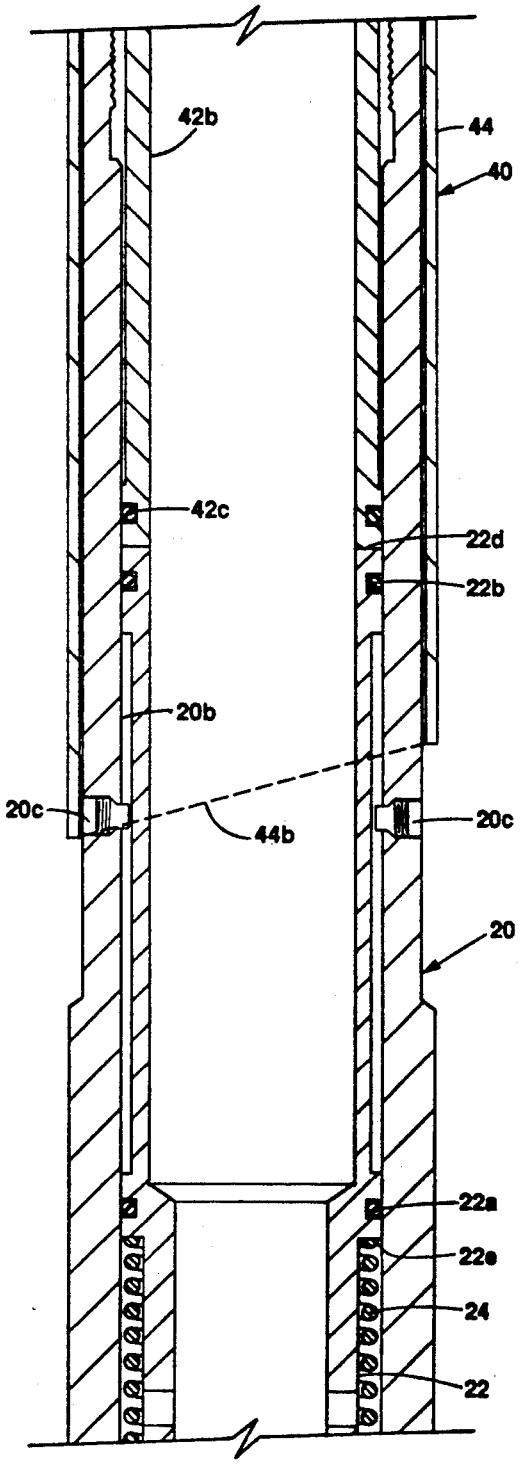
Figure 3C:
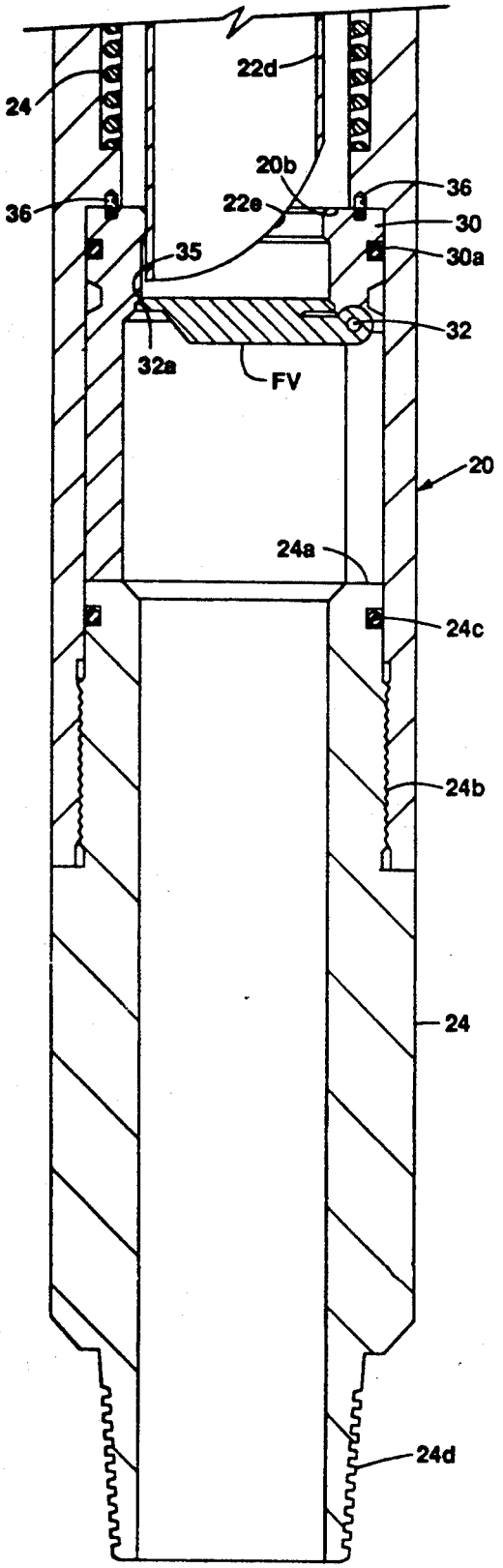

Once the storm danger is passed, it is necessary to retrieve the hurricane plug and the depending drill tool string from the well. This may be conveniently accomplished by a retrieving tool 40 which is shown in FIGS. 3A, 3B and 3C in its initial position relative to the tubular body element 20. It will be noted that in this initial position, the flapper valve FV is still closed as indicated in FIG. 3C.

Retrieving tool 40 comprises a main body sleeve 42 having internal threads 42*a* provided at its top end for connection to the bottom end of a tubing string (not shown) by which the retrieving tool 40 can be lowered into the well. The tubular body sleeve 42 at its lower end is of reduced thickness as indicated at 42*b*, and mounts an O-ring seal 42*c* at its extreme bottom end for sealingly engaging a seal bore portion 20*b* of the tubular body element 20.

The external diameter of the sleeve portion 42*b* is less than the internal diameter of the internal square threads 20*a* of tubular body element 20, so that the sleeve portion 42*b* can readily pass through such threads, as well as a set of external threads 42*c* which are provided on the tubular body sleeve 42 to cooperatively engage with an internal set of threads 20*e* provided in the bore of the tubular body element 20, at a position below the internal threads 20*a*.

To facilitate the engagement of threads 42*c* of the main body sleeve 42 with threads 20*e* of the tubular body element 20, a guide sleeve 44 is provided, which is dimensioned to snugly surround the exterior of the top portion 20*d* of the tubular body element 20. Guide sleeve 44 is secured to the upper portion of the body sleeve 42 by threads 44*a*. The lower end of guide sleeve 40 is cut off at a helix as indicated at 44*b* to facilitate the telescopic engagement of the guide sleeve 44 with the top portion 20*d* of the tubular body element 20.

With the guide sleeve 44 thus engaged, it is readily possible to effect a threaded engagement of the threads 20*e* and 42*c* by rotational movement, preferably to the right, of the tubing string supporting the retrieval unit 40. Such rotation produces an axially downward movement of the sleeve portion 42, producing an abutting engagement of such sleeve portion 42 with the top end 22*d* of the actuating sleeve 22.

Figure 4C:
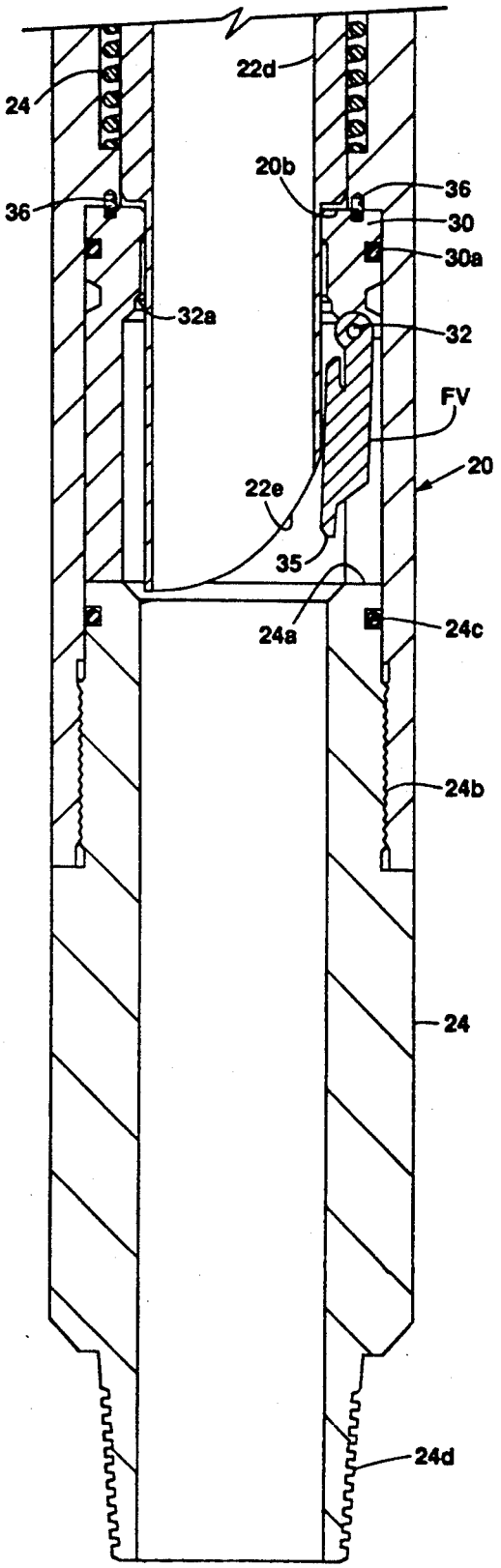

Thus, as the rotation of the tubing string is continued, the actuating sleeve 22 will be displaced downwardly to the position illustrated in FIG. 4C, where the flapper valve is open. In this position, a downwardly facing external shoulder 42*d* provided on the upper end of the body sleeve 42 will engage the upwardly facing end surface 20*f* of the tubular body sleeve 20, thus locking the retrieval tool 40 to the tubular body element 20 for co-rotation. The additional rotation of the body sleeve 20 will then effect the rotation of the depending hurricane plug and result in the unsetting of such plug in conventional fashion. The entire apparatus, including the retrieval tool 40, the tubular body element 20, the depending hurricane plug and the drill string suspended from the bottom of the hurricane plug can then be readily removed from the well.

The convenience and reliability of the aforedescribed valving system for a hurricane plug will be readily apparent to those skilled in the art. The running tool 10 cannot be detached from the hurricane plug until the plug is firmly set in the well. When the time comes to retrieve the valving system, the safety valve is opened, effecting pressure equalization, prior to any unsetting of the hurricane plug, by the downward movement of the actuating sleeve 22 produced by rotation and downward movement of the retrieval tool 40 through the internal threads 20*e* provided in the tubular body element 20.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A setting, valving, pressure equalizing, unsetting and retrieval system for a subterranean well hurricane plug settable by rotation in a selected direction followed by application of setdown weight and unsettable by further rotation in said selected direction comprising:

an elongated tubular body threaded at its lower end;

means for securing said threaded lower end of said tubular body to said hurricane plug;

a flapper valve pivotally mounted in the wall of said tubular body and spring biased into seating engagement with said valve seat;

a first tubular string for inserting and setting said hurricane plug in the well bore having a tubular running tool at the bottom end of the string;

said tubular body having a first internally threaded bore portion, the hand of said first internally threaded bore portion being opposite to said selected direction of rotation;

a floating, externally threaded nut secured to said running tool for co-rotation but axially movable relative to said running tool from a lower position of engagement with said first internally threaded bore portion to an upper position free from said engagement;

shearable means responsive to a predetermined setdown weight for preventing upward movement of said floating nut;

means responsive to a limited rotation of said first tubular string in said selected direction followed by the application of a setdown weight for setting said hurricane plug and immovably securing said tubular body, whereby an increase in setdown weight to said predetermined value shears said shearable means; and whereby rotation of said first tubular string effects the backing up of said floatable nut to disengage from said first internally threaded bore section of said tubular body to permit removal of said running tool from the well by said first tubular string;

an actuating sleeve slidably mounted in the bore of said tubular body above said annular valve seat and movable downwardly through said annular valve seat to engage said flapper valve;

resilient means urging said actuating sleeve upwardly;

said tubular body having a second internally threaded bore section above the uppermost position of said actuating sleeve, the hand of said second internally threaded bore section corresponding to said selected direction of rotation;

a tubular retrieval element having threaded means on its upper end for connection to a second tubing string extending to the well surface;

said tubular retrieval element having external threads on its medial portion engagable with said second internally threaded bore section and a lower end surface abuttable with the upper end of said actuating sleeve;

the axial spacing of said lower end surface and said external threads of said retrieval element being proportioned to produce a full opening of said flapper valve by downward movement of said actuating sleeve resulting from rotation of said tubular retrieval element in said selected direction to move downwardly through said second threaded bore section; and stop means for preventing further rotation of said tubular retrieval element relative to said tubular body when said flapper valve is fully open, whereby further rotation of said tubular retrieving element effects unsetting of said hurricane plug for retrieval by said second tubular string.

2. The apparatus of claim 1 wherein said actuating sleeve has an inclined bottom surface constructed and arranged to initially engage that portion of said flapper valve remotely spaced from its pivotal axis; and means for maintaining a fixed angular alignment of said actuating sleeve relative to the pivotal axis of said flapper in all axial positions of said actuating sleeve.

3. The apparatus of claim 2 wherein said actuating sleeve has an angular bottom surface constructed and arranged to initially engage with that portion of said flapper valve remotely spaced from its pivotal axis;

an axial slot in said actuating sleeve;

a radially, inwardly projecting pin in said tubular body engaging said slot to maintain a fixed angular alignment of said actuating sleeve relative to the pivotal axis of said flapper in all axial positions of said actuating sleeve.

4. The apparatus of claim 1 further comprising:

first sealing means intermediate said actuating sleeve and said bore of said tubular body; and second sealing means intermediate the lower portion of said tubular retrieval element and said bore of said tubular body, whereby pressured well fluids pass upwardly through the tubing string when said flapper valve is opened.

5. The apparatus of claim 1 further comprising:

a guide sleeve secured to the upper portion of said tubular retrieval element in surrounding relationship and extending substantially below the bottom end of said tubular retrieval element;

said guide sleeve having an internal bore diameter exceeding the external diameter of the upper end of said tubular body, whereby said guide sleeve can be lowered over the upper end of said tubular body to facilitate the engagement of said internally threaded bore section of said tubular body with said external threads on said tubular retrieval element.

6. A pressure equalizing, unsetting and retrieval system for a subterranean well hurricane plug settable by rotation in a selected plug direction followed by application of setdown weight and unsettable by further rotation in said selected direction, comprising an elongated tubular body threaded at its lower end;

means for securing said threaded lower end of said tubular body to said hurricane plug;

a downwardly facing annular valve seat formed in the lower portions of said tubular body;

a flapper valve pivotally mounted in the wall of said tubular body and spring biased into seating engagement with said valve seat;

an actuating sleeve slidably mounted in the bore of said tubular body above said annular valve seat and movable downwardly through said annular valve seat to engage said flapper valve;

resilient means urging said actuating sleeve upwardly;

said tubular body having an internally threaded bore section above the uppermost position of actuating sleeve, the hand of said threaded bore section corresponding to said selected direction;

a tubular retrievable element having threaded means on its upper end for connection to a tubing string extending to the well surface;

said tubular retrieval element having external threads on its medial portion engagable with said internally threaded bore section and a lower end surface abuttable with the upper end of said actuating sleeve;

the axial spacing of said lower end surface and said external threads of said retrieval element being proportioned to produce a full opening of said flapper valve by downward movement of said actuating sleeve resulting from rotation of said tubular retrieval element in said selected direction; and stop means for preventing further rotation of said tubular retrieval element relative to said tubular body when said flapper valve is fully open, whereby further rotation of said tubular retrieving element effects unsetting of said hurricane plug for retrieval by said tubing string.

7. The apparatus of claim 6 wherein said actuating sleeve has an inclined bottom surface constructed and arranged to initially engage that portion of said flapper valve remotely spaced from its pivotal axis; and means for maintaining a fixed angular alignment of said actuating sleeve relative to the pivotal axis of said flapper in all axial positions of said actuating sleeve.

8. The apparatus of claim 6 wherein said actuating sleeve has an inclined bottom surface constructed and arranged to initially engage with that portion of said flapper valve remotely spaced from its pivotal axis;

an axial slot in said actuating sleeve;

a radially, inwardly projecting pin in said tubular body engaging said slot to maintain a fixed angular alignment of said actuating sleeve relative to the pivotal axis of said flapper in all axial positions of said actuating sleeve.

9. The apparatus of claim 6 further comprising:

first sealing means intermediate said actuating sleeve and said bore of said tubular body; and second sealing means intermediate the lower portion of said tubular retrieval element and said bore of said tubular body, whereby pressured well fluids pass inwardly through the tubing string when said flapper valve is opened.

10. The apparatus of claim 6 further comprising:

a guide sleeve secured to the upper portion of said tubular retrieval element in surrounding relationship and extending substantially below the bottom end of said tubular retrieval element; and said guide sleeve having an internal bore diameter exceeding the external diameter of the upper end of said tubular body, whereby said guide sleeve can be lowered over the upper end of said tubular body to facilitate the engagement of said internally threaded bore section of said tubular body with said external threads on said tubular retrieval element.

11. A setting and valving system for a subterranean well hurricane plug settable by rotation in a selected direction followed by application of setdown weight comprising:

an elongated tubular body threaded at its lower end;

means for securing said threaded lower end of said tubular body to said hurricane plug;

a downwardly facing annular valve seat formed in the lower portions of said tubular body;

a flapper valve pivotally mounted in the wall of said tubular body and spring biased into seating engagement with said valve seat;

a tubular string for inserting and setting said hurricane plug in the well bore having a tubular running tool at the bottom end of the string;

said tubular body having an internally threaded bore portion;

a floating, externally threaded nut secured to said running tool for co-rotation but axially movable relative to said running tool from a lower position of engagement with said first internally threaded bore portion to an upper position free from said engagement;

shearable means responsive to a predetermined setdown weight for preventing upward movement of said floating nut;

means responsive to a limited rotation of said first tubular string in a selected direction followed by the application of a setdown weight for setting said hurricane plug and immovably securing said tubular body, whereby an increase in setdown weight to said predetermined value shears said shearable means; and whereby rotation of said tubular string effects the backing up of said floatable nut to disengage from said first internally threaded bore section of said tubular body to permit removal of said running tool from the well by said tubular string.

12. The apparatus of claim 11 further comprising:

an actuating sleeve slidable mounted in the bore of said tubular body and movable downwardly through said annular valve seat to engage said flapper valve; and a force transmitting sleeve secured in depending relation to said running tool and engagably with the upper end of said actuating sleeve to move said actuating sleeve downwardly to open said flapper valve when said running tool is secured to said tubular body by said floatable nut.

13. The apparatus of claim 1 further comprising:

a force transmitting sleeve secured in depending relation to said running tool and engagably with the upper end of said actuating sleeve to move said actuating sleeve downwardly to open said flapper valve when said running tool is secured to said tubular body by said floatable nut.

14. A setting, valving, pressure equalizing, unsetting and retrieval system for a subterranean well hurricane plug settable by rotation in a selected direction followed by application of setdown weight and unsettable by further rotation in said selected direction comprising:

an elongated tubular body threaded at its lower end;

means for securing said threaded lower end of said tubular body to said hurricane plug;

a flapper valve pivotally mounted in the wall of said tubular body and spring biased into seating engagement with said valve seat;

a first tubular string for inserting and setting said hurricane plug in the well bore having a tubular running tool at the bottom end of the string;

said tubular body having a first internally threaded bore portion, the hand of said first internally threaded bore portion being opposite to said selected direction of rotation;

a floating, externally threaded nut secured to said running tool for co-rotation but axially movable relative to said running tool from a lower position of engagement with said first internally threaded bore portion to an upper position free from said engagement;

shearable means responsive to a predetermined setdown weight for preventing upward movement of said floating nut;

means responsive to a limited rotation of said first tubular string in said selected direction followed by the application of a setdown weight for setting said hurricane plug and immovably securing said tubular body, whereby an increase in setdown weight to said predetermined value shears said shearable means; and whereby rotation of said first tubular string effects the backing up of said floatable nut to disengage from said first internally threaded bore section of said tubular body to permit removal of said running tool from the well by said first tubular string;

an actuating sleeve slidably mounted in the bore of said tubular body above said annular valve seat and movable downwardly through said annular valve seat to engage said flapper valve;

resilient means urging said actuating sleeve upwardly;

said tubular body having a second internally threaded bore section above the uppermost position of said actuating sleeve, the hand of said second internally threaded bore section corresponding to said selected direction of rotation;

a tubular retrieval element having threaded means on its upper end for connection to a second tubing string extending to the well surface;

said tubular retrieval element having external threads on its medial portion engagable with said second internally threaded bore section and a lower end surface abuttable with the upper end of said actuating sleeve;

the axial spacing of said lower end surface and said external threads of said retrieval element being proportioned to produce a full opening of said flapper valve by downward movement of said actuating sleeve resulting from rotation of said tubular retrieval element in said selected direction to move downwardly through said second threaded bore section; and stop means for preventing further rotation of said tubular retrieval element relative to said tubular body when said flapper valve is fully open.

15. The apparatus of claim 14 wherein said actuating sleeve has an inclined bottom surface constructed and arranged to initially engage that portion of said flapper valve remotely spaced from its pivotal axis; and means for maintaining a fixed angular alignment of said actuating sleeve relative to the pivotal axis of said flapper in all axial positions of said actuating sleeve.

16. The apparatus of claim 14 further comprising:

first sealing means intermediate said actuating sleeve and said bore of said tubular body; and second sealing means intermediate the lower portion of said tubular retrieval element and said bore of said tubular body, whereby pressured well fluids pass upwardly through the tubing string when said flapper valve is opened.

17. The apparatus of claim 14 further comprising:

a guide sleeve secured to the upper portion of said tubular retrieval element in surrounding relationship and extending substantially below the bottom end of said tubular retrieval element;

said guide sleeve having an internal bore diameter exceeding the external diameter of the upper end of said tubular body, whereby said guide sleeve can be lowered over the upper end of said tubular body to facilitate the engagement of said internally threaded bore section of said tubular body with said external threads on said tubular retrieval element.

18. A pressure equalizing, unsetting and retrieval system for a subterranean well hurricane plug settable by rotation in a selected plug direction followed by application of setdown weight comprising an elongated tubular body threaded at its lower end;

means for securing said threaded lower end of said tubular body to said hurricane plug;

a downwardly facing annular valve seat formed in the lower portions of said tubular body;

a flapper valve pivotally mounted in the wall of said tubular body and spring biased into seating engagement with said valve seat;

an actuating sleeve slidably mounted in the bore of said tubular body above said annular valve seat and movable downwardly through said annular valve seat to engage said flapper valve;

resilient means urging said actuating sleeve upwardly;

said tubular body having an internally threaded bore section above the uppermost position of actuating sleeve, the hand of said threaded bore section corresponding to said selected direction;

a tubular retrievable element having threaded means on its upper end for connection to a tubing string extending to the well surface;

said tubular retrieval element having external threads on its medial portion engagable with said internally threaded bore section and a lower end surface abuttable with the upper end of said actuating sleeve;

the axial spacing of said lower end surface and said external threads of said retrieval element being proportioned to produce a full opening of said flapper valve by downward movement of said actuating sleeve resulting from rotation of said tubular retrieval element in said selected direction; and stop means for preventing further rotation of said tubular retrieval element relative to said tubular body when said flapper valve is fully open.

19. The apparatus of claim 18 wherein said actuating sleeve has an inclined bottom surface constructed and arranged to initially engage that portion of said flapper valve remotely spaced from its pivotal axis; and means for maintaining a fixed angular alignment of said actuating sleeve relative to the pivotal axis of said flapper in all axial positions of said actuating sleeve.

20. The apparatus of claim 18 further comprising:

first sealing means intermediate said actuating sleeve and said bore of said tubular body; and second sealing means intermediate the lower portion of said tubular retrieval element and said bore of said tubular body, whereby pressured well fluids pass inwardly through the tubing string when said flapper valve is opened.

21. A setting and valving system for a subterranean well hurricane plug settable by rotation in a selected direction followed by application of setdown weight comprising:

an elongated tubular body threaded at its lower end for connecting to a hurricane plug;

a downwardly facing annular valve seat formed in the lower portions of said tubular body;

a flapper valve pivotally mounted in the wall of said tubular body and spring biased into seating engagement with said valve seat;

an actuating sleeve slidably mounted in the bore of said tubular body and movable downwardly in said tubular body to engage said flapper valve;

a tubular string for inserting and setting said hurricane plug in the well bore having a tubular running tool at the bottom end of the tubular string;

means including shearable members for detachably securing said running tool within the bore of said tubular body;

a force transmitting sleeve secured in depending relation to said tubular running tool and abuttingly engagable with the upper end of said actuating sleeve to move said actuating sleeve downwardly to open said flapper valve when said running tool is secured to said tubular body;

means responsive to a limited rotation of said tubular string in a selected direction followed by the application of setdown weight for setting said hurricane plug and immovably securing said tubular body, whereby an increase in setdown weight to a predetermined value shears said shearably members and permits retrieval of said running tool;

resilient means for moving said actuating sleeve upwardly as said running tool is retrieved, thereby opening said flapper valve; and stop means for retaining said actuating sleeve in said tubular body.

22. A setting and valving system for a subterranean well hurricane plug settable by rotation in a selected direction followed by application of setdown weight comprising:

an elongated tubular body threaded at its lower end for connection to a hurricane plug;

a downwardly facing annular valve seat formed in the lower portions of said tubular body;

a flapper valve pivotally mounted in the wall of said tubular body and spring biased into seating engagement with said valve seat;

an actuating sleeve slidably mounted in the bore of said tubular body and movable downwardly to engage said flapper valve;

a tubular string for inserting and setting said hurricane plug in the well bore having a tubular running tool at the bottom end of the tubular string;

said tubular body having an internally threaded bore portion;

a floating, externally threaded nut secured to said running tool for co-rotation but axially movable relative to said running tool from a lower position of engagement with said first internally threaded bore portion to an upper position free from said engagement;

a force transmitting sleeve secured in depending relation to said tubular running tool and abuttingly engagable with the upper end of said actuating sleeve to move said actuating sleeve downwardly to open said flapper valve when said running tool is secured to said tubular body by said floatable nut;

shearable means responsive to a predetermined setdown weight for preventing upward movement of said floating nut;

means responsive to a limited rotation of said first tubular string in a selected direction followed by the application of a setdown weight for setting said hurricane plug and immovably securing said tubular body, whereby an increase in setdown weight to a predetermined value shears said shearable means;

whereby further rotation of said tubular string effects the backing up of said floatable nut to disengage from said first internally threaded bore section of said tubular body to permit removal of said running tool from the well by said tubular string;

resilient means for moving said actuating sleeve upwardly as said running tool is retrieved, thereby opening said flapper valve; and stop means for retaining said actuating sleeve in said tubular body.

* * * * *

UNITED STATES PATENT AND TRADEMARK OFFICE

CERTIFICATE OF CORRECTION

PATENT NO. : 5,154,228

DATED : October 13, 1992

INVENTOR(S) : Louis M. Gambertoglio, Michael J. Loughlin, Louis E. West, Jr.

It is certified that error appears in the above-identified patent and that said Letters Patent is hereby corrected as shown below:

At column 3, line 22, insert "constitute" between "1C" and "vertical";

at column 3, line 36, insert "are" between "4C" and "views";

Signed and Sealed this

Eleventh Day of January, 1994

*Attest:*

Bruce Lehman

BRUCE LEHMAN

*Attesting Officer*

*Commissioner of Patents and Trademarks*